US009902184B2

(12) United States Patent
Good-Man

(10) Patent No.: US 9,902,184 B2
(45) Date of Patent: Feb. 27, 2018

(54) MAGNETICALLY BOUND MEDIUM WITH REATTACHABLE PAGES

(71) Applicant: Charles Good-Man, Aliso Viejo, CA (US)

(72) Inventor: Charles Good-Man, Aliso Viejo, CA (US)

(73) Assignee: REKONECT, INC., Aliso Viejo, CA (US)

( * ) Notice: Subject to any disclaimer, the term of this patent is extended or adjusted under 35 U.S.C. 154(b) by 1049 days.

(21) Appl. No.: 14/178,465

(22) Filed: Feb. 12, 2014

(65) Prior Publication Data

US 2015/0224806 A1 Aug. 13, 2015

(51) Int. Cl.

| | |
|---|---|
| ***D21H 17/67*** | (2006.01) |
| ***D21H 17/68*** | (2006.01) |
| ***D21H 21/14*** | (2006.01) |
| ***D21H 23/04*** | (2006.01) |
| ***D21H 27/00*** | (2006.01) |
| ***B42D 13/00*** | (2006.01) |
| ***B42D 1/00*** | (2006.01) |
| ***D21H 17/00*** | (2006.01) |
| ***D21H 17/25*** | (2006.01) |
| ***B42D 1/06*** | (2006.01) |

(52) U.S. Cl.

CPC ..... *B42D 13/00* (2013.01); *B42D 1/00* (2013.01); *B42D 1/06* (2013.01); *D21H 17/25* (2013.01); *D21H 17/675* (2013.01); *D21H 17/68* (2013.01); *D21H 17/74* (2013.01); *D21H 21/14* (2013.01); *D21H 23/04* (2013.01); *D21H 27/00* (2013.01)

(58) Field of Classification Search

CPC ..... D21H 17/63; D21H 17/67; D21H 17/675; D21H 17/68; D21H 17/74; D21H 21/14; D21H 23/02; D21H 23/04; D21H 27/00

USPC ..... 162/138, 181.1, 181.4, 181.5, 181.9

See application file for complete search history.

(56) References Cited

U.S. PATENT DOCUMENTS 2,547,948 A * 4/1951 Kornei ..... G11B 5/68 162/138

3,145,326 A 8/1964 McGannon (Continued)

FOREIGN PATENT DOCUMENTS

WO 2012175821 12/2012

*Primary Examiner* — Eric Hug

(74) *Attorney, Agent, or Firm* — Jafari Law Group

(57) ABSTRACT

The present magnetically bound media with reattachable pages exemplarily comprise a magnetic binding, one or more reattachable pages, and one or more conductive metals attached to the pages and magnetically attracted to the magnetic binding. Thus, a user of the magnetically bound media may disengage one or more of the pages from the magnetic binding and reintegrate those pages into the magnetic binding in any order. This allows for customization of information presentation, sequence, and selection. The small size of the magnetic binding also affords a smaller minimum apparatus size and a quicker means with which to remove, rearrange, and reintegrate pages. Furthermore, the magnetic binding permits pages to be secured in a more professionally presentable manner without punched holes. In an exemplary embodiment, the magnetic binding is a cylindrical or a prismatic, rectangular neodymium or samarium alloy secured within the bound media by a magnet cover or clasp.

5 Claims, 6 Drawing Sheets

(56) References Cited

U.S. PATENT DOCUMENTS

| | | | | | |
|---|---|---|---|---|---|
| 3,751,839 | A | | 8/1973 | Mitchell | |
| 4,234,378 | A | * | 11/1980 | Iwasaki | D21H 17/34 162/138 |
| 4,466,639 | A | | 8/1984 | Finnegan | |
| 4,588,209 | A | | 5/1986 | Zebrowski | |
| 4,948,463 | A | * | 8/1990 | Kinsley, Jr. | D21H 17/67 148/525 |
| 5,048,869 | A | | 9/1991 | Schwartz | |
| 5,380,043 | A | | 1/1995 | Schwartz | |
| 5,575,503 | A | | 11/1996 | Takahashi | |
| 5,709,409 | A | | 1/1998 | Engle | |
| 6,273,660 | B1 | | 8/2001 | Ozgen | |
| 6,793,251 | B2 | | 9/2004 | Stark | |
| 6,940,377 | B1 | | 10/2005 | Martin | |
| 7,744,128 | B2 | | 6/2010 | El-Sorrogy | |
| 8,289,352 | B2 | | 10/2012 | Vartanian | |
| 2007/0226069 | A1 | | 9/2007 | Sanchez | |
| 2007/0252377 | A1 | | 11/2007 | El-Sorroge | |
| 2009/0017334 | A1 | * | 1/2009 | Kurihara | D21H 21/40 428/800 |
| 2012/0200074 | A1 | | 8/2012 | Kuch | |
| 2013/0176091 | A1 | | 7/2013 | Lancaster-Larocque | |
| 2014/0125047 | A1 | | 6/2014 | Thibierge | |

* cited by examiner

MAGNETICALLY BOUND MEDIUM WITH REATTACHABLE PAGES

TECHNICAL FIELD OF THE INVENTION

The present invention relates in general to a magnetically bound medium with reattachable pages, and more specifically, to a medium such as a notebook, journal, or notepad, which includes a magnetic binding and a plurality of pages adapted to magnetically bind to the binding so that each page may be detached and reattached from the medium.

BACKGROUND OF THE INVENTION

Bound media, or media which makes use of a binding to hold together one or more pages, is an incredibly valuable means with which to store information. This media can be highly structured and order specific. Books, for instance, typically follow a standard order, usually beginning with a table of contents, and thereafter comprising any number of pages often broken up into subsections or chapters before the book ends. The information within the books typically progress linearly, as reading material generally follows from preceding information and leads into forthcoming information.

However, currently existing bound mediums, including books, journals, or textbooks, cannot address the problem that arises when one or more pages are either mistakenly or purposefully removed from the medium, yielding disjointed information. Traditional binding is designed to keep pages bound within a medium, but is not equipped to allow for reattachment, replacement, or rearrangement of pages should a page disengage from that binding.

To illustrate the problem, imagine a schoolbook. Schoolbooks are often reused for a number of years and utilized by a plethora of students. Understandably, pages may become ripped out or otherwise damaged over the years. Presently, no plausible solution exists to restore the schoolbook to its former condition. It may be possible to purchase individual pages, though these pages cannot simply be integrated into the completed binding. Thus, students may be forced to learn material with crucial information absent from the schoolbook. Alternatively, the school may be forced to purchase an entirely new schoolbook.

Another issue that may arise with a typical bound medium is when an individual such as a student, a business person, or a professional uses or creates such a medium to give a presentation. For example, a professional wishing to bind a presentation to enhance the look or make it appear polished may, after binding, decide to present the information in a different order, but may have to fumble through the bound pages to present in the desired order. The rigid binding may not allow the individual to alter the presentation's order so as to present it in a logical and linear fashion.

One solution to the issue illustrated above may be to use a ringed binder, thus allowing for the order of pages in a presentation to be rearranged. For example, the three rings may be opened at their peak to allow for removal and rearrangement of pages. However, such binders are necessarily large and bulky irrespective of the number of pages they may contain. Rearrangement of pages in a ringed binder is slow and cumbersome, as it requires manually opening the rings, taking out a page, closing the rings, finding the appropriate spot to insert the detached page, opening the rings, and finally reinserting the page. Moreover, pages in a ringed binder are likely to tear over time in the areas where the holes are punched in the pages. Eventually, when such tears reach the edge of the page, the page may no longer be secured by the ringed binder and the binder's utility is severely diminished. Additionally, the requirement that such pages be three-hole punched severely limits the professional applicability of the ringed binding, as books and other similar media are seldom if ever three-hole punched. Instead, they are unadulterated and permanently bound, thus reintroducing the problems first presented.

There is a need in the art to address the issues discussed thus far. It is to these ends that the present invention has been developed, i.e. magnetically bound media allowing for a combination of the unadulterated, professional look of traditional binding, and the customizable and reattachable functionality of ringed binding.

SUMMARY OF THE INVENTION

To minimize the limitations in the prior art, and to minimize other limitations that will be apparent upon reading and understanding the present specification, the present invention describes a magnetically bound medium with reattachable pages.

A magnetically bound medium, in accordance with one embodiment of the present invention, comprises: a magnetic binding; one or more reattachable pages; and an adhered component integrated with the one or more reattachable pages, wherein the adhered component is magnetically attracted to the magnetic binding.

A magnetically bound medium, in accordance with another embodiment of the present invention, comprises a magnetic binding that includes a support structure, a diametrically magnetized magnet, and a cover for securing the magnet to the support structure. Furthermore, the bound medium includes one or more reattachable pages; and an adhered component integrated with each of the one or more reattachable pages, wherein the adhered component is magnetically attracted to the magnetic binding.

A magnetically bound book in accordance with yet another embodiment of the present invention comprises: a front cover; a back cover; a magnetic binding situated between the front and back covers, the magnetic binding further comprising: a support structure, a cylindrically shaped diametrically magnetized magnet, and a clasp for securing the cylindrically shaped diametrically magnetized magnet to the support structure. Furthermore, the book includes one or more reattachable pages, and a magnetizable powder adhered to each of the one or more reattachable pages, wherein the magnetizable powder is magnetically attracted to the magnetic binding of the magnetically bound book.

A page for a magnetically bound medium, in accordance with one embodiment of the present invention, comprises a sheet body, which contains a pulp fiber, said pulp fiber comprising: a first portion of organic material; a second portion of inorganic material; and a third portion of a magnetic component, wherein the first, second and third portions are integrated into a single mixture for forming the pulp fiber, wherein the magnetic component is distributed throughout the mixture, in a manner so as to spread the magnetic component towards an edge of the sheet body.

A method of making a magnetizable sheet for a magnetically bound medium, in accordance with practice of one embodiment of the present invention, comprises providing a pulp fiber for making one or more sheets of paper; creating a composition by mixing a first pulp solution obtained from the pulp fiber and integrating a magnetizable powder component with the first pulp solution; and processing the composition into a magnetizable sheet of paper, wherein processing the composition into a magnetizable sheet of paper further comprises: creating a second pulp solution from the pulp fiber, wherein the second pulp solution does not include the magnetizable component; and integrating the second pulp solution with the first pulp solution when creating the composition, in a manner so that the first pulp solution and the second pulp solution make two distinct areas of the composition, wherein only one of the distinct areas of the composition comprises the magnetizable component powder.

It is an objective of the present invention to enable removal and reattachment of pages to and from bound media so that the pages can be reassembled in any sequence.

It is another objective of the present invention to provide a more functional means of writing for both left and right-handed persons without the hassle of ringed notebooks and binders.

It is another objective of the present invention to decrease the overall size and minimum size of bound media.

It is yet another objective of the present invention to eliminate the hassle of removing pages from ring-bound media, including three-ringed binders and spiral notebooks.

It is yet another objective of the present invention to provide a page that comprises a magnetic component on at least one of the edges, for detaching and reattaching to a magnetically bound medium.

It is yet another objective of the present invention to provide a faster means to remove and insert pages in bound media.

It is yet another objective of the present invention to provide a method of making a sheet of paper that is detachable and reattachable to a magnetically bound medium.

These and other advantages and features of the present invention are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 1(*b*) depicts the book shown in FIG. 1(*a*), now shown in an open position, revealing the magnetic binding that is configured to bind with the one or more magnetically reattachable pages.

FIG. 2(*b*) depicts a close-up perspective view of a page that has been adapted with an adhered component that comprises a magnetic strip, which has been adhered to the inner edge of the page, in accordance with an exemplary embodiment of the present invention.

FIG. 2(*c*) depicts a close-up side view of a page that has been adapted with an adhered component that comprises a magnetic material, which has been adhered to the inner edge of the page, in accordance with another exemplary embodiment of the present invention.

FIG. 2(*d*) depicts a close-up side view of a page that has been infused with a magnetic component, which has been integrated with the pulp solution from which the page is made, in accordance with another exemplary embodiment of the present invention.

FIG. 2(*e*) depicts a close-up side view of a page, a portion of which has been infused with a magnetic component, which has been integrated with the pulp solution from which the page is made, in accordance with another exemplary embodiment of the present invention.

FIG. 2(*f*) is a flowchart of a method for making a page for a magnetically bound medium, in accordance with practice of one embodiment of the present invention.

DETAILED DESCRIPTION OF THE DRAWINGS

In the following discussion that addresses a number of embodiments and applications of the present invention, reference is made to the accompanying drawings that form a part hereof, where depictions are made, by way of illustration, of specific embodiments in which the invention may be practiced. It is to be understood that other embodiments may be utilized and changes may be made without departing from the scope of the present invention.

In the present disclosure, a bound medium refers to a tangible medium of expression utilized to communicate or express ideas, wherein the medium utilizes bindings to hold together one or more pages. A binding may refer to a chemical or mechanical means for holding a written or pictorial medium together. Without limiting or deviating from the spirit or scope of the present invention, such a bound medium may refer to a book, notebook, notepad, binder, coloring book, novel, picture book, photo album, workbook, portfolio, presentation booklet, memo pad, journal, sketchbook, planner, ledger, pamphlet, or any other similar written or pictorial medium. Furthermore, it does not matter the manner in which the written or pictorial information is presented within the media. For example, photos, images, drawings, words, or any other information may be affixed to individual pages, written or drawn directly onto one or more pages, or displayed via a digital format onto one or more pages of the bound media. Hence, the present disclosure will discuss several examples of the present invention, but it is noted that other embodiments may be practiced and used, which are not specifically described herein.

A primary objective of the present invention is to provide users with the capacity to write, draw, or otherwise make use of a page on a bound medium, and be able to remove, re-organize, or replace pages that have at one point or another been removed. The present invention improves over the idea of detachable pages in that pages in the present invention may be reattached to the binding of the media once a page has been used, or once a new page is made available.

More importantly, reattachment is achieved with a specialized magnetic binding that binds to each individual page, which is independently adapted to magnetically bind to the binding of the medium. The application ranges from enabling users to merely remove a page in order to take it with them, to replacing lost pages on books. Furthermore, reattachment is useful for other purposes such as updating information on new editions of books and more generally, offering a versatile manipulation of the content within the medium. Because the medium, in accordance with the present invention, does not require the use of rings or latches to open and release each individual page, each page may be easily positioned in a desired order within the medium, without having to reorganize or remove superfluous pages.

Figure 1A:
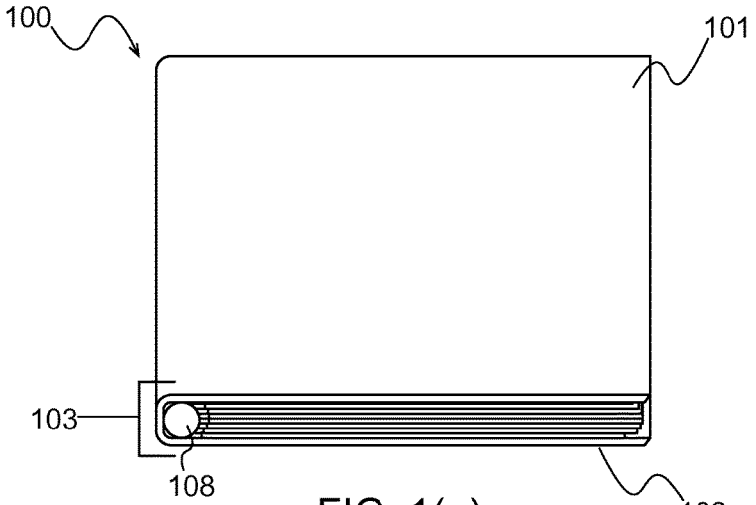
FIG. 1(*a*) depicts an example of a magnetically bound medium or a specialized book, comprising a magnetic binding and one or more magnetically reattachable pages, in accordance with an exemplary embodiment of the present invention.
Figure 1B:
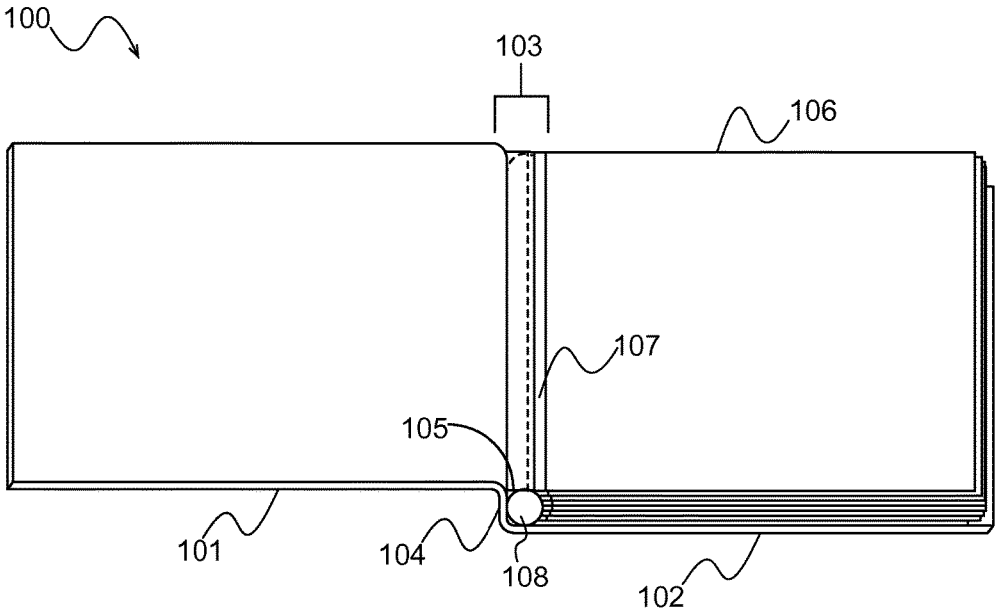
Figure 2A:
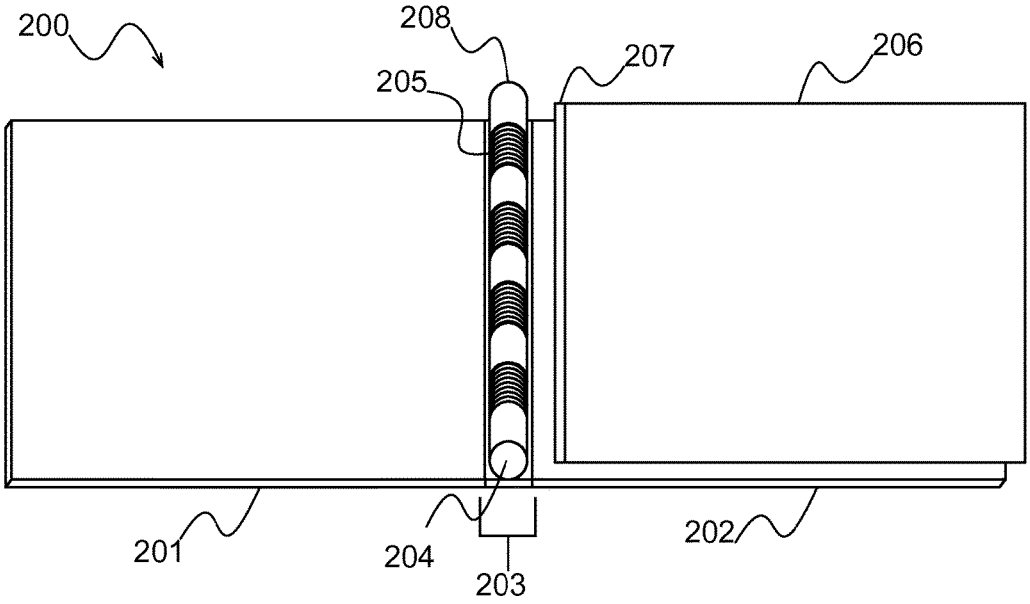
FIG. 2(*a*) depicts another example of a magnetically bound medium, in accordance with another exemplary embodiment of the present invention.
Figure 2B:
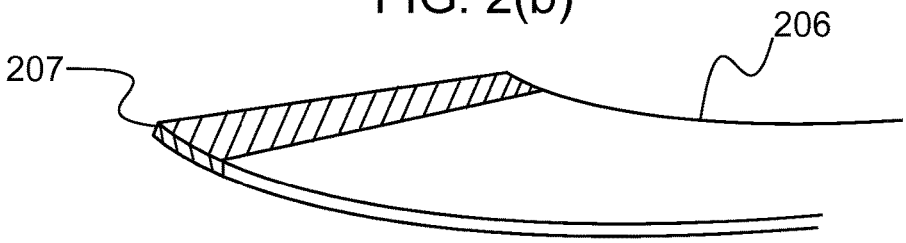
Figure 2C:
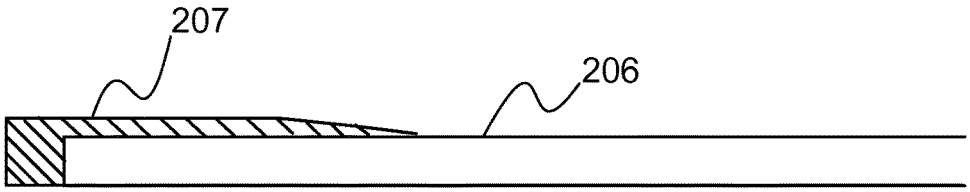
Figure 2D:
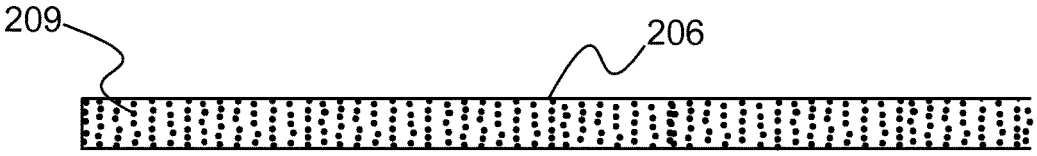
Figure 2E:
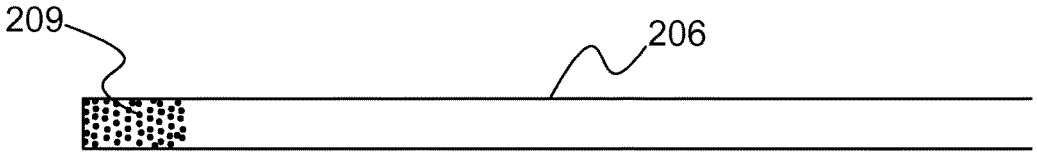
Figure 2F:
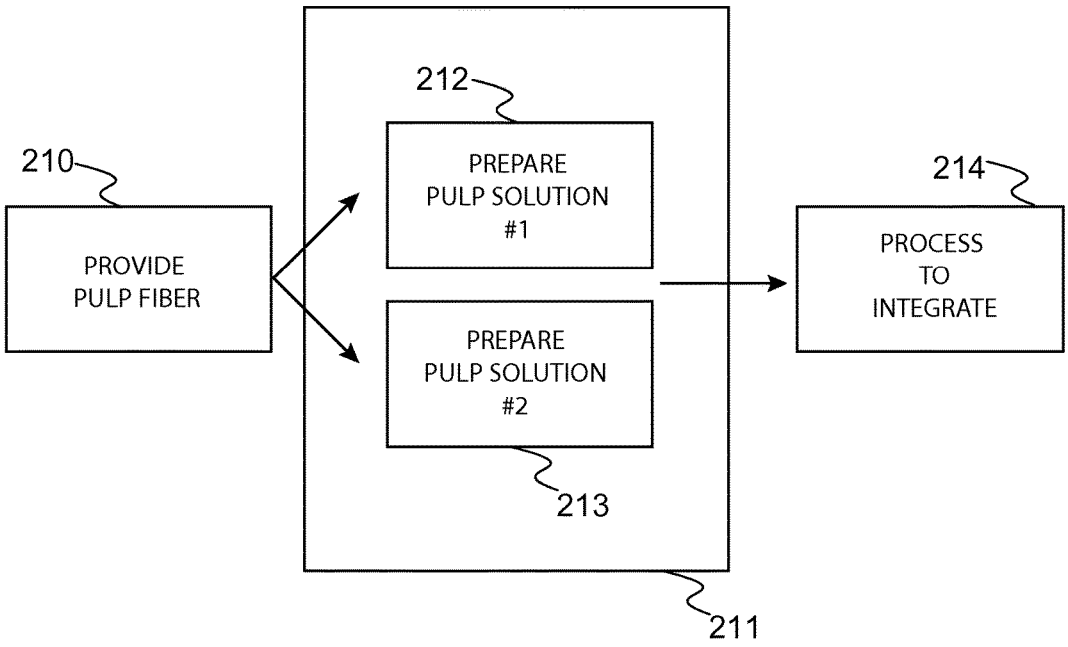

Turning now to the figures, FIG. 1(*a*) and FIG. 1(*b*) depict an example of a magnetically bound medium, namely a book, comprising a magnetic binding and one or more magnetically reattachable pages, in accordance with an exemplary embodiment of the present invention. Specifically, FIG. 1(*a*) and FIG. 1(*b*) depicts bound book (book 100). Book 100 comprises front cover 101; back cover 102; magnetic binding 103, which includes spine 104, magnet 108, and magnet cover 105; and multiple pages, such as page 106, each page comprising adhered component 107.

Front cover 101 is typically the top-most part of book 100 when it is closed and facing right-side up. In this case, front cover 101 rests adjacent to the bound media's first page. Front cover 101 may be any type of protective covering that is typically utilized to bind together the pages of a journal, notebook, novel, or more generally a book. Front cover 101 may be constructed in any familiar fashion without deviating from the scope of the present invention. For example, front cover 101 may be a hard cover, a soft cover, and may include any other feature such as dust jackets, or any other type of protective means typical of traditional types of book-bindings and covers.

Similarly, back cover 102 is typically the bottom-most part of book 100 when it is closed and facing right-side up. Back cover 102 rests adjacent to the bound medium's last page. Therefore, when closed, book 100 has front cover 101 on top and back cover 102 on bottom. As with front cover 101, back cover 102 may also comprise the typical cover designs known in the art without deviating from the scope of the present invention.

Magnetic binding 103 serves as the binding for book 100 and may be an alternative to traditional adhesive and sewn bindings, as well as ringed bindings. Magnetic binding 103 extends from the bottom of book 100 to the top, running along the length of spine 104. Magnetic binding 103 comprises spine 104, which supports a magnetic component such as magnet 108, and magnet cover 105 for enclosing the magnetic component. Additionally, magnetic binding 103 enables the magnetic binding and disjoining of the reattachable pages that make up the bound medium.

Spine 104 is a support structure that links front and back covers 101, 102 together on the binding side and supports a magnet housed within magnetic binding 103. Spine 104 runs substantially perpendicular to the pages shown. Spine 104 may be constructed in any known manner without deviating from the scope of the present invention. For example, if the covers of a desired book in accordance with the present invention are hard covers, it may be desirable to implement a hard spine. Similarly, paper backs, or soft covers may be implemented, in which case a softer spine may be utilized. Importantly, it is the implementation of the magnetic component, which spine 104 supports or houses, that enables the reattachment of the plurality of pages. Hence, spine 104 should be constructed of any material that is suitable for allowing magnetic binding 103 to properly support and house the magnetic component—in the present embodiment, magnet 108.

It should also be noted that while bound media such as more traditional books and notebooks may implement a spine, spine 104 is not required in alternative embodiments of the present invention. Nevertheless, implementing spine 104 with magnetic binding 103 may be desirable for both structural support and aesthetic purposes.

As stated above, magnetic binding 103 houses a magnetic component. This magnetic component may be any type of magnet suitable for retaining a plurality of pages within the bound media. Hence, the magnetic component may comprise of one or more permanent magnets or a single magnet, or a wide variety of types of magnets without limiting or deviating from the scope of the present invention. In an exemplary embodiment, magnetic binding houses a permanent magnet such as magnet 108.

Magnet 108 may typically comprise of a diametric magnet, but as stated above other magnets may be incorporated as well. In the presently depicted embodiment, magnetic binding 103 is diametrically magnetized, meaning the magnet's north and south poles are split along its diameter. While this feature of the magnet is not meant to limit the scope of the present invention, diametric magnets are desirable because they allow use of a shape that is compatible with the well known structure of bound mediums such as books, notebooks, journals and the like.

Magnet 108 has a cylindrical shape, although other shapes may be used as well without deviating from the scope of the present invention. While non-circular shapes will not have a diameter, it is still possible to diametrically magnetize these magnet shapes by separating the polarities along where the diameter would be if the shape were circular in nature. Such non-circular shapes as well as non-cylindrical circular or spherical shapes exist as alternative embodiments of the present invention. Furthermore, in alternative embodiments, magnet 108 may be axially magnetized, meaning the north and south poles of the magnet are separated along a shape's height rather than its diameter.

Magnet 108 may be held within magnetic binding 103 in any known manner without deviating from the scope of the present invention. Magnet 108 may be held by an adhesive, or a cloth that may be sown into spine 104, or may be held together by clasps, or any other means of holding and securely maintaining magnet 108 in a stable and suitable position. In one embodiment, shown in FIG. 1(*b*), magnet 108 is secured in place by sandwiching the magnet between spine 104 and magnet cover 105.

Magnet cover 105 holds magnet 108 in place against spine 104. Together with spine 104 and back cover 102, magnet cover 105 forms an enclosure to secure magnet 108 within magnetic binding 103 and prevent the magnetic component from being displaced. This enclosure extends parallel to back cover 102 initially then contours to the shape of magnetic binding 103 thereafter.

A plurality of specialized pages that are adapted to magnetically bind with magnetic binding 103, may be positioned in any order within book 100. These pages may be attached, removed, and reattached as mentioned above. Page 106, is an exemplary embodiment of one of these pages in accordance with the present invention.

Page 106 may be any page type, such as but not limited to, a standard printing page or photo album page. Page 106 may be any type of page suitable for the desired type of bound medium. For example, and without limiting the scope of the present invention, in an embodiment in which book 100 is a drawing book, page 106 may be a blank drafting page suitable for drawing. In another embodiment, in which book 100 is a notebook, page 106 may be a lined page, suitable for making notes or keeping written records. Alternatively, page 106 may be any type of page and may comprise graphing paper, lined paper, or blank pages made of drafting paper. Similarly, the thickness and type of paper used may be any type known in the industry so long as the type of paper may be adapted with an adhered component that utilizes a magnetic for magnetically binding the page to magnetic binding 103. Therefore, page 106 typically comprises adhered component 107.

Adhered component 107 may be a single component or multiple components, so long as it comprises a magnetizable material that will enable page 106 to magnetically bid with magnet 108 of magnetic binding 103. Thus, adhered component 107 may comprise one or more substances suitable for magnetization. For example, and without limiting or deviating from the scope of the present invention, adhered component 107 may be a magnetizable powdered material, for instance, a metal powder, applied to an adhesive to adhere it to page 106. Alternatively, adhered component may be a metal strip constructed of thin metallic materials which will magnetically bind to a magnetic source. By way of a non-limiting example, a metallic strip which is either adhesive or non-adhesive may be used.

In an exemplary embodiment, the magnetizable material of adhered component 107 is iron powder or resin, though any number of metals may be used in its stead. Furthermore, the adhesive component of adhered component 107 may be any standard adhesive used on metallic powder that would be known by a person of ordinary skill in the art.

Adhered component 107 may be on any part of a page and employ a wide variety of dimensions. In an exemplary embodiment, adhered component 107 runs parallel to magnetic binding 103 and possesses a width of less than one tenth of an inch. In another embodiment, adhered component 107 possesses a width of one sixteenth of an inch so that only a small portion of page 106 is utilized for purposes making page 106 reattachable to magnetic binding 103.

Page 106 is just one of many pages magnetically bound in book 100. In the present embodiment, pages will not perfectly overlay one another due to the dynamic width of the cylindrical magnet to which said pages are magnetically attracted. However, in other embodiments, other shapes in lieu of a cylindrical magnet may be used that allow for pages to perfectly overlay one another. For instance, a substantially flat shape such as a flat rectangular prism may be implemented so that the width of the prism is consistent throughout its height. Thus, with a given media, for instance book 100, pages would be substantially perpendicular to the height of the magnetic binding.

Turning now to the next figures, FIG. 2(*a*) depicts another example of a magnetically bound medium, in accordance with another exemplary embodiment of the present invention. Specifically, the bound medium in FIG. 2(*a*) is a notebook or notebook 200. Notebook 200 comprises front cover 201, back cover 202, and magnetic binding 203, which includes spine 204, magnet 208, and binding clasp 205. Additionally, page 206 may be one of a plurality of pages contained in notebook 200, page 206 comprising adhered component 207.

In the present exemplary embodiment, magnetic binding 203 includes a substantially cylindrical magnet 208, diametrically magnetized with a length approximately equal to that of spine 204 or adhered component 207. While magnet 208 is shown substantially cylindrical, alternative embodiments may exist without deviating from the scope of the present invention. For instance, the magnet used for a binding may employ other shapes such as, but not limited to, a triangular shape, a rectangular shape, an arc or half cylinder shape, a concave cylindrical shape, a disc shape, a block, a ring, or spherical shapes, without limiting the scope of the present invention. These shapes may be prismatic or non-prismatic, or comprise of any other shape that is suitable for creating a binding for a book, notebook, journal or the like.

In an exemplary embodiment, magnet 208 is a permanent neodymium alloy magnet that includes neodymium, iron, and boron. Furthermore, in this exemplary embodiment, the neodymium alloy may be coated with a conductive metal such as nickel or copper, though other conductive metals may also be employed in addition to or in lieu of nickel and copper. For instance, the alloy may be coated with epoxy, zinc, gold, silver, tin, or parylene. Alternatively, the alloy may remain uncoated. However, coating the neodymium alloy with a conductive metal may be desirable as this affords corrosion resistance as well as an aesthetically pleasing, shiny finish. In another embodiment, magnet 208 is a permanent samarium alloy magnet comprising samarium and cobalt, which may also utilize the same or different coating materials as the neodymium alloy.

Binding clasp 205 secures magnet 208 through several restraints tightly fitted against spine 204 of magnetic binding 203. Binding clasp 205 refers to the entire set of clasps illustrated in FIG. 2(*a*). Binding clasp 205 may be mechanically or adhesively secured into a combination of front cover 201, back cover 202, and spine 204 and may be made of a myriad of materials that would be known or easily ascertainable for a person of ordinary skill in the art.

Page 206 may be any page that would be present in any written or pictorial medium. As depicted in FIG. 2(*a*), page 206 is disengaged from magnetic binding 203. Such disengagement is possible by a user of notebook 200 applying a deliberate counterforce greater than the attractive magnetic force of magnetic binding 203. This magnetic force is effective on page 206 due to adhered component 207, whereby the magnetizable material present in adhered component 207 is magnetically attracted to magnet 208 of magnetic binding 203. If desired, page 206 may immediately be reintegrated into notebook 200 in any order by placing adhered component 207 of page 206 in close proximity to magnetic binding 203.

Removal and reintegration of pages in accordance with the present invention is nearly instantaneous and effortless, as opposed to removing and reintegrating pages in a ringed binder, which comparatively requires considerably more time and effort. Additionally, and with continued reference to ringed binders, the present invention does not require bulky rings to accompany it, thereby decreasing the minimum size of a binder to that of the magnet in magnetic binding 203 and not of the large rings seen in traditional ringed binders.

Spiral notebooks are a variation of a ringed binder wherein the spirals do not open, and pages are held in place through an abundance of tiny holes present where the spirals make contact with the page. Such notebooks allow for removal of pages through either removing the entire page including the now-torn tiny holes or by disengaging the page from the rings along a perforated line, wherein the section with tiny holes remains within the notebook.

In any case, after tearing out a page from a spiral notebook, the user has a number of issues to address. First, the frilled interior is unsightly and may get caught on other pages. Or, if the frilled interior was separated from the page along the perforated line, it takes up unnecessary space in the notebook. Thus, the user is presented with a secondary task upon removing a paper, a task that is eliminated by the discussed magnetically bound media. Second, any user of ringed binders, including spiral notebooks, has encountered the frustration of having their writing hand impeded by the rings. For instance, a right-handed individual writing on a left side page or a left-handed individual writing on a right side page frequently bumps into the rings and is forced to write in an unnatural configuration, consequently inhibiting legible penmanship. Due to the strong magnetic attraction present between the exemplary neodymium alloy magnet and adhered component of the present invention, magnetic binding 203 can be considerably smaller than traditional spirals and rings and thus mitigate penmanship woes. Additionally, a user may simply remove a page from the magnetically bound media, write on the isolated, unbound page, and reintegrate it at a later time to completely eliminate the aforementioned problem with writing in an unnatural configuration.

To bind adhered component 207 to page 206, in an exemplary embodiment, application of an adhesive may be carried out using a single coat applied to both sides of a page along any edge. In another exemplary embodiment, conductive metal may be added onto the adhesive at a substantially fixed ratio. By way of a non-limiting example, a mixture may be created in which about 325 grams of magnetizable material may be added to an adhesive for approximately every eight ounces of adhesive paint, which is exemplarily acrylic, though other materials may also be used without deviating from the spirit or scope of the present invention. This typically results in one or two grams of magnetizable material on each sheet created. Regardless, the adhesive may be applied using any number of methods, including but not limited to, serigraphy, printing, air spraying, brushing, or brayer rolling. Of course, other methods could be used, including taping a magnetic component to page 206, or integrating a magnetic component right into the pulp material used for constructing page 206. Various methods of implementing adhered component 207 or a similar magnetic component, into page 206 are discussed in turn.

The following figures help to illustrate two methods or manners in which adhered component 207 may be implemented with page 206. FIG. 2(*b*) depicts a close-up perspective view of a page that has been adapted with an adhered component that comprises a magnetic strip, which has been adhered to the inner edge of the page, in accordance with an exemplary embodiment of the present invention. And FIG. 2(*c*) depicts a close-up side view of a page that has been adapted with another type of adhered component in accordance with another exemplary embodiment of the present invention.

FIG. 2(*b*) depicts a portion of page 206, which in an exemplary embodiment comprises adhered component 207 that includes a magnetic strip adhered to the inner edge of the page. Adhered component 207 may be adhered to page 206 using known methods, the exact means of which would be apparent to a person of ordinary skill in the art. In the present embodiment, adhered component 207 does not utilize a powder or resin to render it magnetizable to magnetic binding 204. Adhered component 207 may or may not make use of an adhesive material in addition to a mechanical means to be secured to page 206.

FIG. 2(*c*) depicts a magnified side view of another embodiment of the page from FIGS. 2(*a*) and 2(*b*), whereby only the width of the page is visible and in which the adhered component hangs over the edge of the page. There may be times when a stronger magnetic attraction between magnetic binding 203 and adhered component 207 is desired. Thus, in the present exemplary embodiment, a slight lip or overhang is created by adhered component 207 so that magnetizable material exists not only on the inside of page 206, but also along its minute width. This permits the magnetizable material to more directly attach to a magnetic binding. In the present figure, a magnetic strip is not used. Instead, a resin, powder, or other similar item may be added to an adhesive material, forming adhered component 207.

FIG. 2(*d*) depicts a close-up side view of page 206, which has been infused with magnetic component 209. The magnetic component may be integrated with the material from which the page is made, in accordance with another exemplary embodiment of the present invention. Similarly, FIG. 2(*e*) depicts a close-up side view of page 206, a portion of which has been infused with magnetic component 209. Thus, in these embodiments of the present invention, rather than applying an adhesive with a magnetic component on top of the sheet, or adding a magnetic strip to the page, a magnetic component, such as a magnetic powder (e.g. containing iron, neodymium) may be integrated into the pulp of the material typically utilized in paper making methods.

For example, and without deviating from the scope of the present invention, When processing the pulp typically used to make a sheet of paper, a magnetic component may be added to this pulp in order to integrate the magnetic component into each sheet. In this manner, the integrated component doesn't have to go through another process or machine to apply the conductive metal, because the metal is applied at the same time when the paper is turned from fibered pulp to a freshly made sheet. This method may be desirable because it offers an inexpensive and cost-effective means of production. Furthermore, integrating magnetic component 209 into each sheet does not create an additional rising to the surface of paper 206, which allows for more pages to fit or connect to magnetic binding 203.

Pulp fiber or a pulp solution may include any known pulp fiber or pulp solution typically utilized for making paper. Pulp fiber may comprise, without limiting or deviating from the scope of the present invention, a first portion of organic materials and a second portion of inorganic materials, both portions mixed with a third portion of a magnetic component that includes a conductive powder as described above. Furthermore, the organic portion may include cellulose, hemicelluloses, and lignin; while the inorganic portion may include calcium carbonate, clay, and titanium oxide. Of course, other known ingredients may be incorporated with a pulp fiber mixture without limiting or deviating from the scope of the present invention.

While the embodiment shown in FIG. 2(*e*) includes only a portion of page 206 infused with magnetic component 209, FIG. 2(*d*) shows an embodiment in which the entire sheet or page 206 is infused with magnetic component 209. In other embodiments, magnetic component 209 may be integrated throughout a border of page 210. Such alternative configurations may be desirable to, for example, create a magnetic edge throughout the entire perimeter of page 206 so that paper may be magnetically attached to magnetic binding 203 on any side or edge. In embodiments in which an entirety of page 206 is infused with magnetic component 209, even if page 206 is cut into any shape, page 206 may still be magnetically attached to magnetic binding 203 by any edge.

Embodiments that implement magnetic component 209, infused or integrated with the sheet material, may be utilized with any type of sheet material without deviating from the scope of the present invention. For example, page 206 may comprise of book paper, business form paper, carbon base paper, carbon paper, coated paper, copier paper, cream wove paper, defense craft paper (i.e. laminates), diary paper, fax base paper, fluorescent paper, general writing paper (i.e. note book paper), greaseproof paper, label paper, laser paper, newsprint, vinyl paper, onion paper (i.e. transparency paper), or any other type of paper type or paper material known in the art.

FIG. 2(*f*) is a flowchart of a method for making a page for a magnetically bound medium, in accordance with practice of one embodiment of the present invention. The method of making a magnetizable sheet for a magnetically bound medium, comprises several steps, including implementation of known methods to create the sheet material—however, a novel composition is ultimately created, in which at least one area of the pulp solution (i.e. a semi-solid composition that may be spread before being rolled into sheets) comprises a magnetizable component so that when the processing is complete, and the pulp solution is rolled, flattened, and dried into sheet paper. Thus, at least one area of the composition (and ultimately the sheet of paper) will contain magnetizable components to allow the sheet of paper to be magnetically bound to a magnetic source such as magnetic binding 203.

For example, and without limiting the scope of the present invention, with this method, a single pulp solution may be utilized to create a page consistent with FIG. 2(*d*), or two separate solutions (only one containing a magnetizable component) may be used to create a sheet of paper consistent with FIG. 2(*e*). Briefly, the method comprises providing a pulp fiber for making one or more sheets of paper; creating a composition by mixing a first pulp solution obtained from the pulp fiber and integrating a magnetizable powder component with the first pulp solution; and processing the composition into a magnetizable sheet of paper by, for example, rolling, flattening, and drying the final composition of either one or two pulp solutions to create the magnetizable sheet.

This method is shown and described in the following steps, however, it is understood that the process may be achieved in any other conceivable sequence without deviating from the scope of the present invention.

In step 210, any known method of creating, or obtaining pulp fiber may be employed; pulp fiber may include any type of pulp fiber commonly used for making paper type materials. For example, and without deviating from the scope of the present invention, pulp fibers may be obtained via a wood free process. Typically, after selecting a type of wood, it is cooked in an acidic solution in order to dissolve the lignin and separate the plant fibers. The selected wood may comprise a single type of wood, or several types—for example, the wood sawed may comprise one or more of the following types of wood: Birch, Poplar, Beech, Eucalyptus, Spruce, Fir, and Pine. In one embodiment, Spruce is the main source of wood as it is typically the strongest for producing strong quality paper sheets. Furthermore, processing or providing paper pulp may include whitening the fiber, washing or processing with chemicals such as bleach using oxygen and peroxide. After this step is complete, the treated pulp may be dried, baled.

In step 211, a pulp solution may be prepared, which includes a conductive or magnetizable component. Generally, preparing the solution allows for the paper fiber to disperse evenly, reducing any uneven densities and thicknesses in unwanted areas. Also, this may provide a desirable opportunity for last minute refining. Thus, in accordance with the present invention, step 211 may comprise of a single step, or of multiple steps in which one or more solutions are prepared in order to create a magnetizable sheet of paper. For example, and without limiting the scope of the present invention, the solution making process may comprise of step 212 in which a single solution is created, or may further comprise of step 213, in which an additional solution is created in order to combine the solutions of step 212 and step 213 and integrate them to form the magnetizable sheets of paper.

In order to create the paper that maximizes the functionality for the magnetic medium, two different pulp solutions may be required; however, this may depend on the cost or even the amount of conductive metal used in making each sheet of paper. That is, in embodiments in which each sheet of paper is fully infused with a conductive metal powder, then only one pulp solution may be required and step 212 may be skipped, as step 212 comprises of a solution that contains no magnetizable or conductive component integrated with the pulp fibers.

However, in other embodiments, only a section of each sheet of paper may contain a conductive metal or magnetizable component. In such embodiments, for example wherein a strip along the edge of each page is utilized to connect the page to the cover of the book, two solutions may be required and hence both steps 212 and 213 may be exercised.

In step 212, the pulp fibers are mixed with water to become pulp solution. This solution is then refined by passing through a known process for making the paper stronger. Wood fibers alone produce rough texted & unevenly dense paper, and fillers such as calcium carbonate and clay may be mixed in to make the paper more opaque and give the paper more controlled thickness and density. Dyes, and other known materials may be implemented into the pulp to improve the appearance of the paper. The pulp solution resulting from step 212 is typically a controlled mix of fibers, fillers and coloring agents suspended in water. As stated above, this solution is to be integrated with a second solution discussed with reference to step 213, in accordance with practice of one embodiment of the present invention.

In step 213, a solution is created in which an added component such as a conductive or magnetizable powder is mixed with typical pulp solution, such as a solution similar to that discussed in step 212. In one embodiment, a highly powderized metal is used, which comprises a −325 mesh or lower of any conductive or magnetizable ingredients, so that the powder's particle size is approximately less than 44 micrometers. Of course, other particle sizes may be implemented without deviating from the scope of the present invention.

In step 214, in embodiments wherein each sheet of paper or page comprise of the magnetic component integrated throughout the entire page, only the pulp solution created in step 213 is utilized and finally processed with known methods to create the magnetizable sheets.

In embodiments in which only a portion of each page comprise a magnetizable component, for example one or more edges of each page, then both solutions of step 212 and step 213 are brought together and pressed through rollers that combine both solutions in the desired configuration. For example, the solutions may be brought together so that only a top portion of each page comprises the magnetizable component. In step 214, typically, a system of rollers is used to press the pulp solutions into the desired sheets, which are then dried to form sheet rolls that contain the magnetizable component integrated into the paper.

Figure 3:
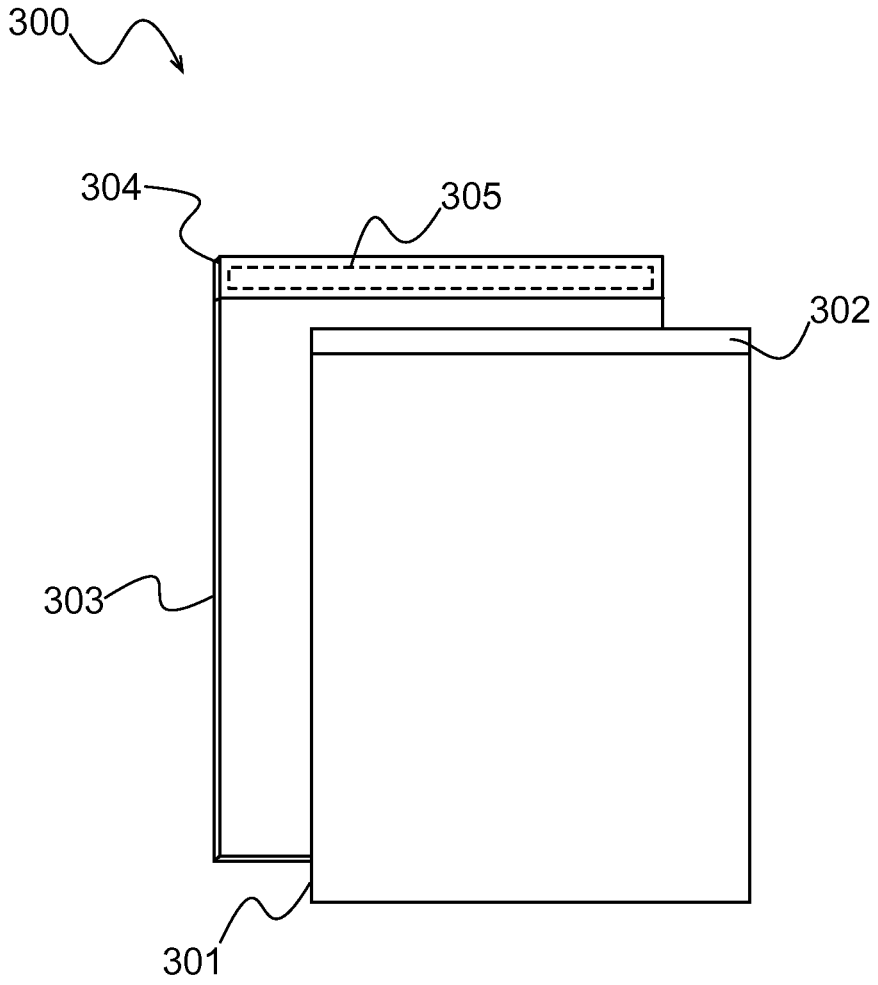
FIG. 3 depicts a page offset from a magnetically bound notepad, the page comprising an adhered component that includes a magnetizable material for binding with the magnetically bound notepad, in accordance with an exemplary embodiment of the present invention.

FIG. 3 depicts a page offset from a magnetically bound notepad, the page comprising a magnetic component that includes a magnetizable material for binding with the magnetically bound notepad, in accordance with an exemplary embodiment of the present invention. Notepad 300 is illustrated, comprising page 301, magnetic component 302, support structure 303, and magnetic binding 304, which includes magnet 305.

With respect to the present figure, page 301 is one which might be found on a notepad, such as a legal pad or sketch pad. Thus, magnetic component 302 is located atop the page on its shorter side where binding traditionally resides in such pads.

Traditional notepads have bindings atop the pad attached to each page, wherein the bound parts of each page remain in the pad even after the rest of the page becomes disengaged. Disengagement occurs at the perforated line spanning across the pad at the bottom of the binding. Such pads mitigate some of the presented problems with current written and pictorial media, such as the space taken up by ringed bingers, but still cannot address the issue of reintegrating the page into the binding once disengaged. Certainly, a user can lodge the page back into the pad and hope that the friction is sufficient to keep it in place, though this technique may lead to pages unexpectedly falling out of the notebook or slipping and being folded or crumpled beneath the weight of the pad. However, the illustrated exemplary embodiment of the present invention alleviates this concern, as demonstrated in the discussion of notepad 300.

Support structure 303 supports the pages of which page 301 will be atop of once it is reintegrated into notepad 300. Furthermore, support structure 303 may provide support for securing magnet 305 and holding it in place at the top of the notepad. Support structure 303 may be constructed of any known and commonly used materials typically used in notepads to provide support for the notepad and to provide a place for the user to support the notepad's pages when writing or drawing on the notepad. Without limiting the scope of the present invention, support structure 303 may be constructed of cardboard, plastics, metals, or any other material suitable for adding structural support to notepad 300. Each of the notepad's pages, including page 301, are kept in place in much the same way as is discussed in FIGS. 1-2, with aid from a magnetic source such as a permanent magnet.

Magnetic binding 304 serves as the simple alternative to the binding present in current notepads. Rather than employ a dense binding of the top portions of each page, the present exemplary embodiment allows the top of each page, for example page 301, to be magnetically attracted to magnetic binding 304 through the magnetic force of magnet 305. Thus, the top of page 301 will be removable and reattachable from notepad 300. As mentioned above, the magnetic binding in this embodiment may too have a cover, either for structural purposes or for aesthetic purposes, or both. As shown, magnetic binding 304 houses magnet 305 within. Naturally, the material from which such a cover is made should be a material that does not interfere with the magnetic properties of the magnetized binding or magnet 305.

Figure 4:
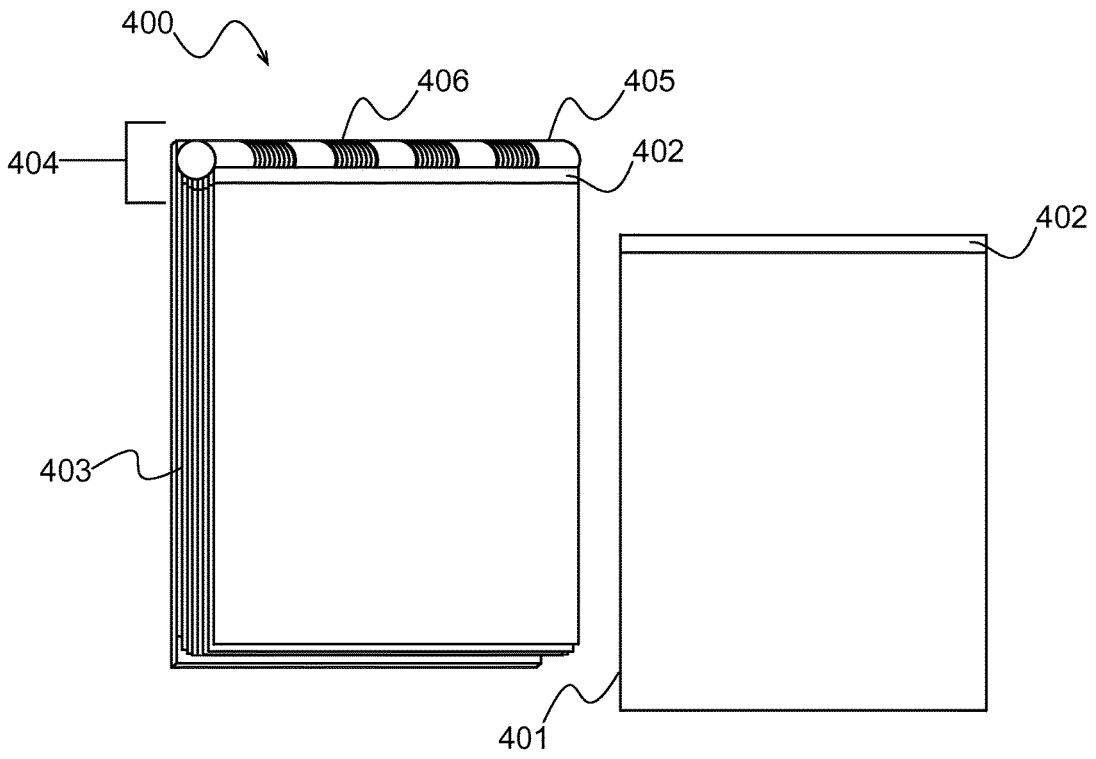
FIG. 4 depicts a page offset from a magnetically bound notepad, the page comprising an adhered component that includes a magnetizable material for binding with the magnetically bound notepad, in accordance with another exemplary embodiment of the present invention.

Finally, FIG. 4 depicts yet another embodiment of the present invention. This embodiment is but one of many variations, and works in the same manner as the embodiments discussed above. Notepad 400 is illustrated, comprising page 401, adhered component 402, support structure 403 for supporting a plurality of pages (shown but not numbered), and magnetic binding 404, which includes magnet 405. In this embodiment, magnet 405 is a diametric magnet that is cylindrical in shape, and has been secured to the notepad's support structure utilizing clasps 406. As with the other embodiments herein, notepad 400 provides users with the ease of attaching and removing pages from the notepad without ripping or damaging each page.

To summate the advantages in the present disclosure of the magnetically bound media, the present invention provides the unique ability to remove and subsequently reattach pages to bound media, allowing for customization of information presentation, sequence, and selection. For instance, a student with homework from several heavy books may choose to only bring home the necessary pages from each book to complete that day's work. Due to the small size of the magnetic binding and the ability to remove pages altogether, the present invention has better functionality for both left and right-handed individuals. With respect to ringed bindings such as three-ring binders and spiral notebooks, the small size of the magnetic binding also affords a smaller minimum size and a quicker means with which to remove, rearrange, and reintegrate pages. Furthermore, the magnetic binding allows for pages to be removably secured in a more professionally presentable manner devoid of hole punches.

This invention can apply to any bound media and is thus widely applicable and, due to the strength of neodymium and samarium alloys, is also highly effective at securing pages in their desired place within the bound media. Moreover, due to the design of such magnetic alloys, the strength of the magnetic binding increases as more conductive pages are added, permitting its use in larger publications and projects. Additionally, the ability to remove and reintegrate pages from reused publications such as school textbooks paves the way for a more cost effective means of replacing damaged media. Therefore, the present invention expands the versatility of bound media while simultaneously increasing functionality, professional aesthetic appeal, and long-term usage of said bound media.

Magnetically bound media with reattachable pages have been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

DESCRIPTION OF REFERENCE SYMBOLS

100: Book
101: Front cover
102: Back cover
103: Magnetic binding
104: Spine
105: Magnet cover
106: Page
107: Adhered component
108: Magnet
200: Notebook
201: Front cover
202: Back cover
203: Magnetic binding
204: Spine

205: Binding clasp
206: Page
207: Adhered component
208: Magnet
209: Magnetic component
300: Notepad
301: Page
302: Adhered component
303: Support structure
304: Magnetic binding
305: Magnet
400: Notepad
401: Page
402: Adhered component
403: Support structure
404: Magnetic binding
405: Magnet
406: Clasp

What is claimed is:

1. A method of making a magnetizable sheet for a magnetically bound medium, comprising:

providing a pulp fiber for making one or more sheets of paper;

creating a composition by mixing a first pulp solution obtained from the pulp fiber and integrating a magnetizable powder component with the first pulp solution; and processing the composition into a magnetizable sheet of paper, including:

creating a second pulp solution from the pulp fiber, wherein the second pulp solution does not include the magnetizable component; and integrating the second pulp solution with the first pulp solution when creating the composition, in a manner so that the first pulp solution and the second pulp solution make two distinct areas of the composition, wherein only one of the distinct areas of the composition comprises the magnetizable component powder.

2. The method of claim 1, wherein the composition comprises:

a first portion of organic material;

a second portion of inorganic material; and a third portion of a magnetic component, wherein the first, second and third portions are integrated into a single mixture for forming the pulp fiber, wherein the magnetic component is distributed throughout the mixture, in a manner so as to spread the magnetic component towards an edge of the sheet body.

3. The method of claim 2, wherein the magnetic component comprises a conductive powder of part iron and part nickel.

4. The method of claim 3, wherein the first portion of organic material comprises cellulose, hemicelluloses, and lignin.

5. The method of claim 4, wherein the second portion of inorganic material comprises calcium carbonate, clay, and titanium oxide.

* * * * *